US007170765B2

(12) United States Patent
Huang

(10) Patent No.: US 7,170,765 B2
(45) **Date of Patent: *Jan. 30, 2007**

(54) CURRENT DISTRIBUTION CIRCUIT

(75) Inventor: Chih-Hsiung Huang, Taoyuan Shien (TW)

(73) Assignee: Delta Electronics, Inc., Taoyuan (TW)

( * ) Notice: Subject to any disclaimer, the term of this patent is extended or adjusted under 35 U.S.C. 154(b) by 142 days.

This patent is subject to a terminal disclaimer.

(21) Appl. No.: 10/968,452

(22) Filed: Oct. 19, 2004

(65) Prior Publication Data

US 2005/0140348 A1 Jun. 30, 2005

(30) Foreign Application Priority Data

Dec. 30, 2003 (TW) ..... 92137537 A
Jan. 12, 2004 (TW) ..... 93100719 A

(51) Int. Cl.
*H02M 7/00* (2006.01)

(52) U.S. Cl. ..... 363/65; 363/71; 307/82

(58) Field of Classification Search ..... 363/65, 363/71, 72; 307/82
See application file for complete search history.

(56) References Cited

U.S. PATENT DOCUMENTS 5,157,269 A * 10/1992 Jordan et al. ..... 307/59
5,521,809 A * 5/1996 Ashley et al. ..... 363/71
6,346,798 B1 * 2/2002 Passoni et al. ..... 323/272
6,528,976 B1 * 3/2003 Lenk et al. ..... 323/282
6,826,064 B2 * 11/2004 Chen et al. ..... 363/65
6,977,829 B2 * 12/2005 Huang ..... 363/72
6,982,885 B2 * 1/2006 Huang ..... 363/65
7,023,191 B2 * 4/2006 Bernacchia et al. ..... 323/282

* cited by examiner

*Primary Examiner*—Bao Q. Vu
(74) *Attorney, Agent, or Firm*—Volpe and Koenig, P.C.

(57) ABSTRACT

A current distribution circuit for parallel power supplies is provided. The parallel power supplies include at least a first power supply and a second power supply, and the current distribution circuit includes a voltage amplifier, a power converting unit, a detecting unit, an equivalent diode, an adjustable amplifier, an adder and an active droop unit. The operating voltage reference of the active droop unit is linearly adjusted for reducing an error resulting from the first power supply and the second power supply while the load is less than a pre-determined value.

20 Claims, 11 Drawing Sheets

CURRENT DISTRIBUTION CIRCUIT

FIELD OF THE INVENTION

The present invention relates to a current distribution circuit, in particular, to a master/slave current distribution circuit for a parallel power supply.

BACKGROUND OF THE INVENTION

Please refer FIG. 1(*a*), which illustrates a conventional master/slave current distribution circuit for a parallel power supply according to the prior art. The conventional master/slave current distribution circuit 1 includes a voltage amplifier 11, an impedance 12, a power converting unit 13, a detecting unit 14, an equivalent diode 15, an adjustable amplifier 16 and an adder 17. The distributions of the output voltages and the output currents of the first power supply PS1 and the second power supply PS2, which are electrically connected in parallel, are able to be stabilized through the operation of the master/slave current distribution circuit 1, which is electrically connected to the first power supply PS1 and the second power supply PS2.

In order to prevent the output unstability resulted from the parallel error between the first power supply PS1 and the second power supply PS2, a gap voltage is provided in the master/slave current distribution circuit 1. For examples, it is feasible to use the equivalent diode 15 as a discrete component for generating a non-linear gap voltage in the linear operating range, i.e. 0~0.4 V. Such a non-linear gap voltage, however, will result in a unstable outputs of the first power supply PS1 and the second power supply PS2 while the value of the gap voltage is too large.

For overcoming the forgoing drawback, a conventional technical scheme, i.e. the droop method, has been developed in the prior art. The droop method relates to obtaining an operation slope S through the equation "$S=\Delta V/V_{0\ max.}$" while the master/slave current distribution circuit 1 is operated under a load from zero to the maximum, wherein $\Delta V$ is an applied voltage range of the master/slave current distribution circuit 1 and $V_{0\ max.}$ is the maximum value of the output voltage.

However, there is still a drawback in the conventional droop method. When the operation slope S is small, i.e. $\Delta V$ is smaller or $V_{0\ max.}$ is larger, the error of the parallel power supply will be too large to make the first power supply PS1 and the second power supply PS2 electrically connect in parallel successfully under a light-load. Please refer to FIG. 1(*b*), which illustrates the relationship between the single output current and the total output current, and the large error between the first and the second power supplies is also shown therein. Moreover, the voltage differences between the first power supply PS1 and the second power supply PS2 must be small enough for being well electrically connected with each other in parallel. Furthermore, the drift of the temperature or the error resulting from the electronic components will also result in an unsuccessful parallel connection between the first power supply PS1 and the second power supply PS2.

In order to overcome the drawbacks in the prior art, an improved master/slave current distribution circuit is provided in the present invention.

SUMMARY OF THE INVENTION

In accordance with the first aspect of the present invention, a current distribution circuit for parallel power supplies having at least a first power supply and a second power supply is provided. The current distribution circuit includes a voltage amplifier, a power converting unit having an input electrically connected to an output of the voltage amplifier and an output electrically connected to a load, a detecting unit having an input electrically connected to the output of the power converting unit and the load, an equivalent diode having an input electrically connected to an output of the detecting unit and an output electrically connected to the parallel power supplies, an adjustable amplifier having an inverting input electrically connected to the output of the detecting unit and the input of the equivalent diode and a non-inverting input electrically connected to the output of the equivalent diode and the parallel power supplies, an adder electrically connected to a non-inverting input of the voltage amplifier and an output of the adjustable amplifier and an active droop unit electrically connected to the output of the detecting unit.

Preferably, an operating voltage reference of the active droop unit is linearly adjusted for reducing an error resulting from the first power supply and the second power supply while the load is less than a pre-determined value.

Preferably, the current distribution circuit is a master/slave circuit.

Preferably, a reference value of an operating voltage is 1%~5% of a value of an output voltage of the current distribution circuit.

Preferably, the voltage amplifier further includes a negative feedback circuit.

Preferably, the negative feedback circuit includes an impedance.

Preferably, the current distribution circuit further includes a gap voltage modulator electrically connected between the output of the detecting unit and the non-inverting input of the adjustable amplifier for modulating a gap voltage therebetween.

Preferably, the gap voltage is raised by the gap voltage modulator while a first value of the load is less than a pre-determined value, and is lowered while a second value of the load is more than the pre-determined value, so as to eliminate an unstability of the first power supply and the second power supply under a light-load.

Preferably, the voltage amplifier and the adjustable amplifier are further electrically connected to a soft-start circuit.

Preferably, an output voltage from the current distribution circuit to the load is fed back to the soft-start circuit, so that the soft-start circuit is driven and has a voltage, and when a value of the voltage is equal to a proportional value of the output voltage, a surge voltage of the output voltage is lowered while the second power supply is operated behind the first power supply.

Preferably, the proportional value is 90%~95% of the output voltage.

According to a second aspect of the present invention, a current distribution circuit for parallel power supplies having at least a first power supply and a second power supply is provided. The current distribution circuit includes a voltage amplifier, a power converting unit having an input electrically connected to an output of the voltage amplifier and an output electrically connected to a load, a detecting unit having an input electrically connected to the output of the power converting unit and the load and an active droop unit electrically connected to the output of the detecting unit.

Preferably, an operating voltage reference of the active droop unit is linearly adjusted for reducing an error resulting from the first power supply and the second power supply while the load is less than a pre-determined value.

Preferably, the current distribution circuit is a master/slave circuit.

Preferably, the current distribution circuit further includes an equivalent diode having an input electrically connected to an output of the detecting unit and an output electrically connected to the parallel power supplies.

Preferably, the current distribution circuit further includes an adjustable amplifier having an inverting input electrically connected to the output of the detecting unit and the input of the equivalent diode and a non-inverting input electrically connected to the output of the equivalent diode and the parallel power supplies.

Preferably, the current distribution circuit further includes a gap voltage modulator electrically connected between the output of the detecting unit and the non-inverting input of the adjustable amplifier for modulating a gap voltage therebetween.

Preferably, the gap voltage is raised by the gap voltage modulator while a first value of the load is less than a pre-determined value and is lowered while a second value of the load is more than the pre-determined value, so as to eliminate an unstability of the first power supply and the second power supply under a light-load.

Preferably, the voltage amplifier and the adjustable amplifier are further electrically connected to a soft-start circuit.

Preferably, an output voltage from the current distribution circuit to the load is fed back to the soft-start circuit, so that the soft-start circuit is driven and has a voltage, and when a value of the voltage is equal to a proportional value of the output voltage, a surge voltage of the output voltage is lowered while the second power supply is operated behind the first power supply.

The foregoing and other features and advantages of the present invention will be more clearly understood through the following descriptions with reference to the drawings, wherein:

BRIEF DESCRIPTION OF THE DRAWINGS

FIG. 1(*b*) is a diagram illustrating the output currents of the current distribution circuit according to the prior art;

FIG. 2(*b*) is a diagram illustrating the relationship between the voltage and the current while the voltage is modulated by the active droop unit according to FIG. 2(*a*);

FIG. 3(*b*) is a diagram illustrating the relationship between the voltage and the current while the voltage is modulated by the gap voltage modulator according to FIG. 3(*a*);

FIG. 3(*c*) is a diagram illustrating the output currents while the parallel error is reduced by the master/slave current distribution circuit in FIG. 3(*a*);

FIG. 3(*d*) is a diagram illustrating the waveform of the voltage in the soft-start circuit according to FIG. 3(*a*);

FIG. 3(*e*) is a diagram illustrating the surge voltage generated in the master/slave current distribution circuit according to FIG. 1(*a*);

FIG. 3(*f*) is a diagram illustrating the waveform of the voltage in the conventional soft-start circuit according to the prior art.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 2A:
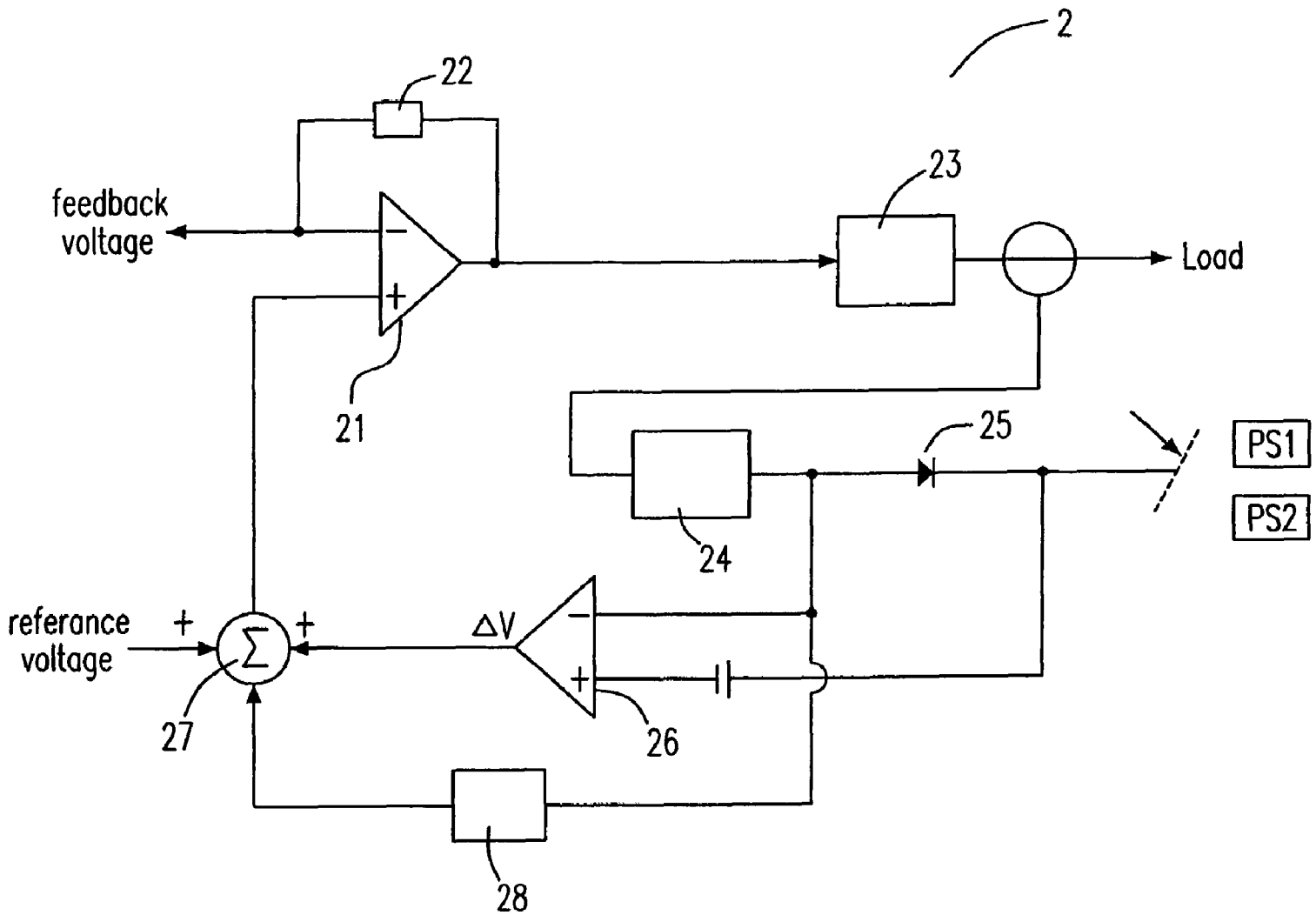
FIG. 2(*a*) is a diagram illustrating the master/slave current distribution circuit according to a first preferred embodiment of the present invention.
Figure 2B:
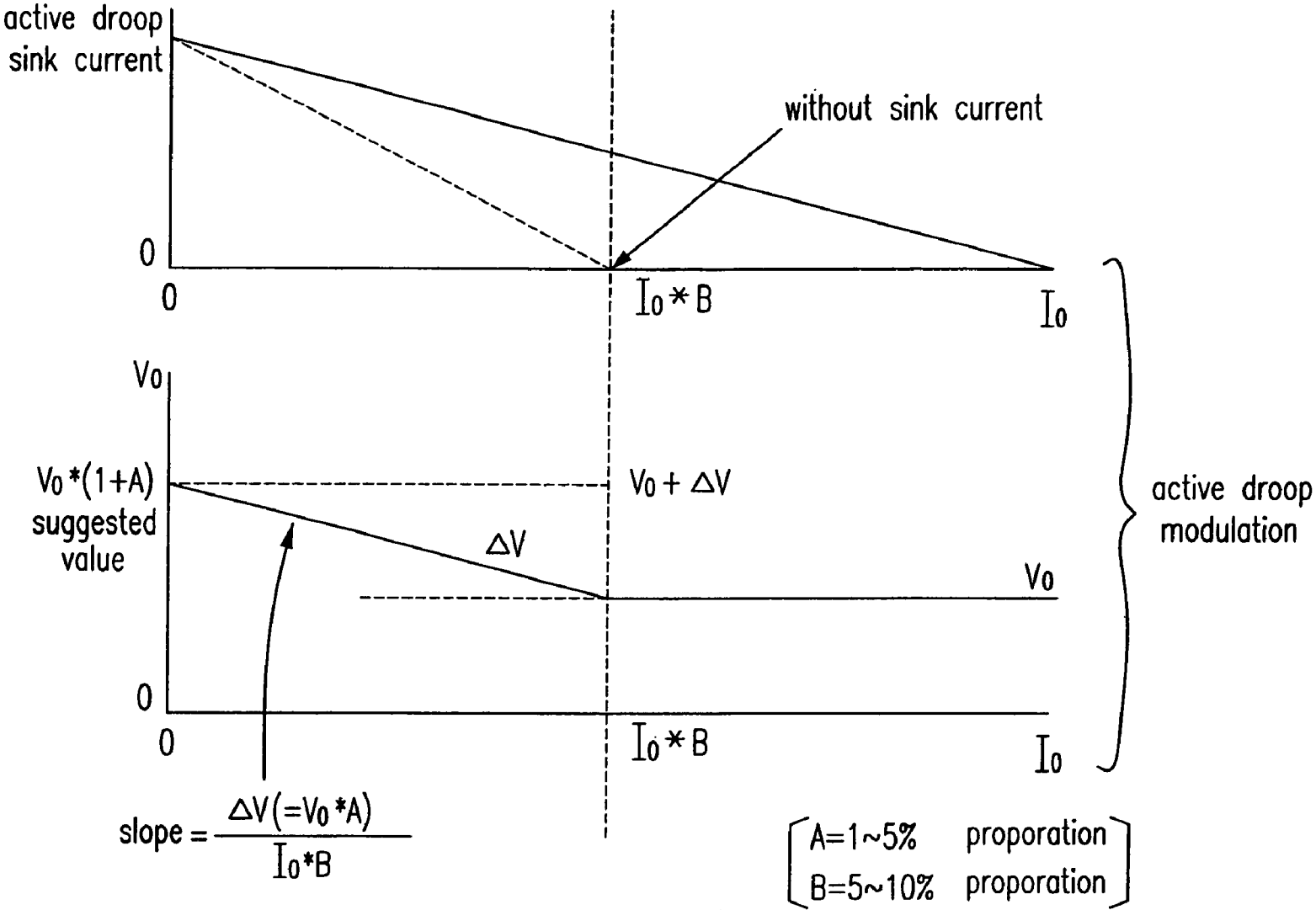
Figure 3A:
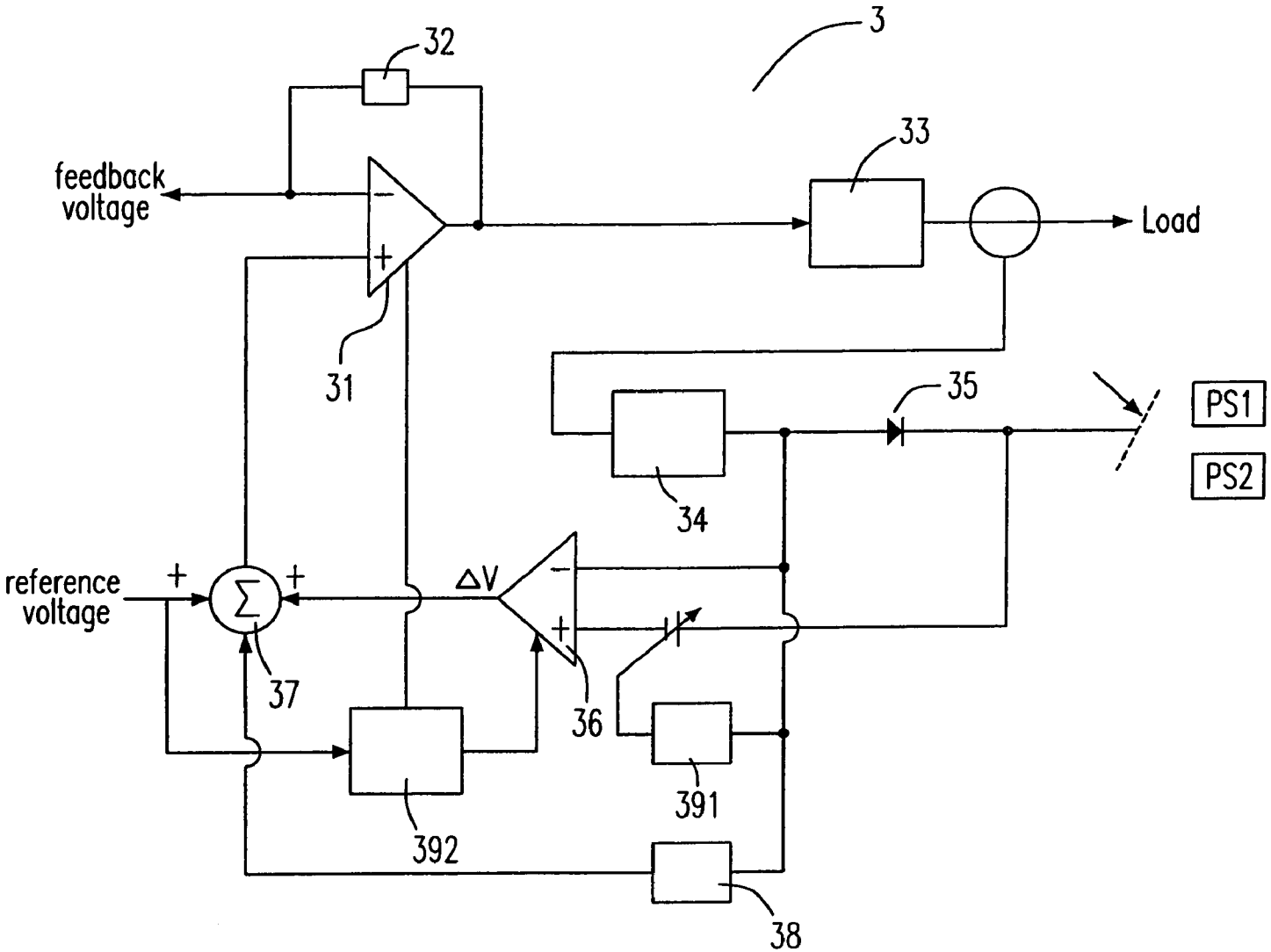
FIG. 3(*a*) is a diagram illustrating the master/slave current distribution circuit including the gap voltage modulator and the soft-start circuit according to a second preferred embodiment of the present invention.
Figure 3B:
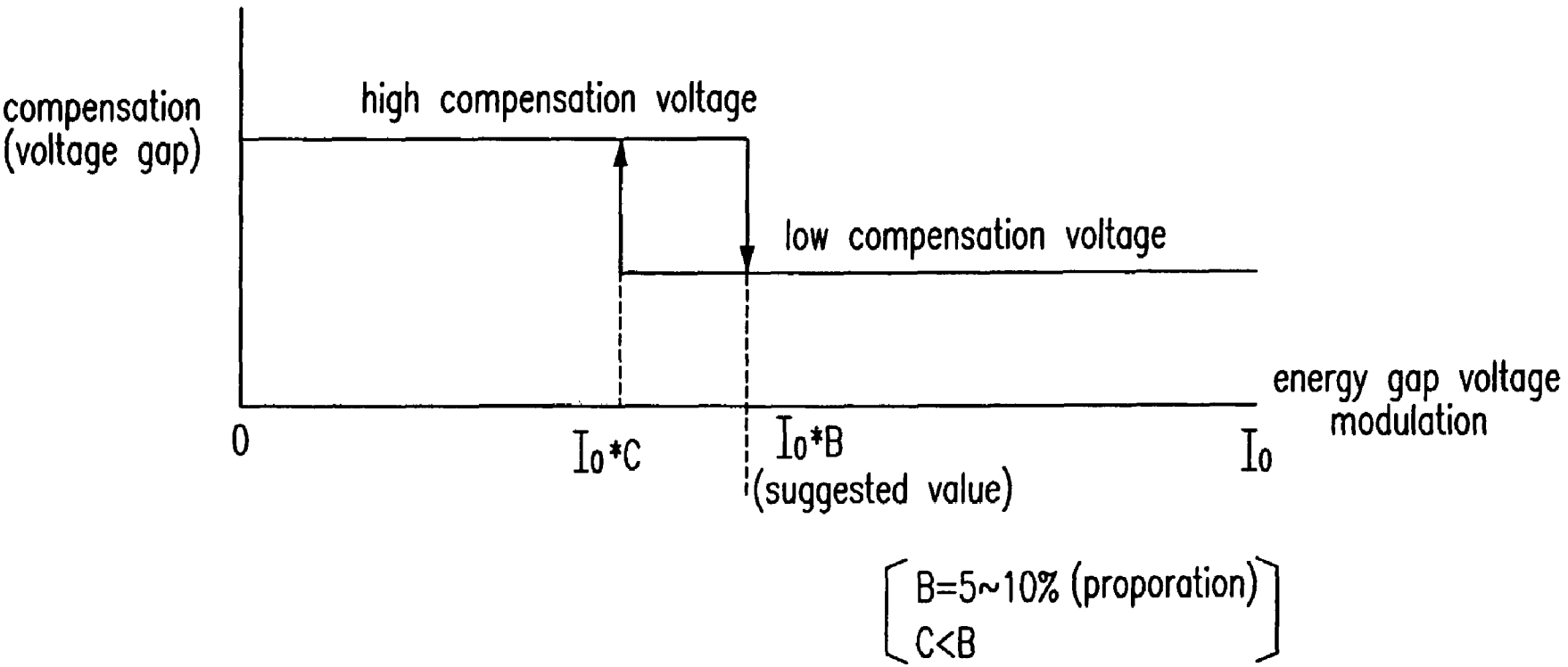
Figure 3C:
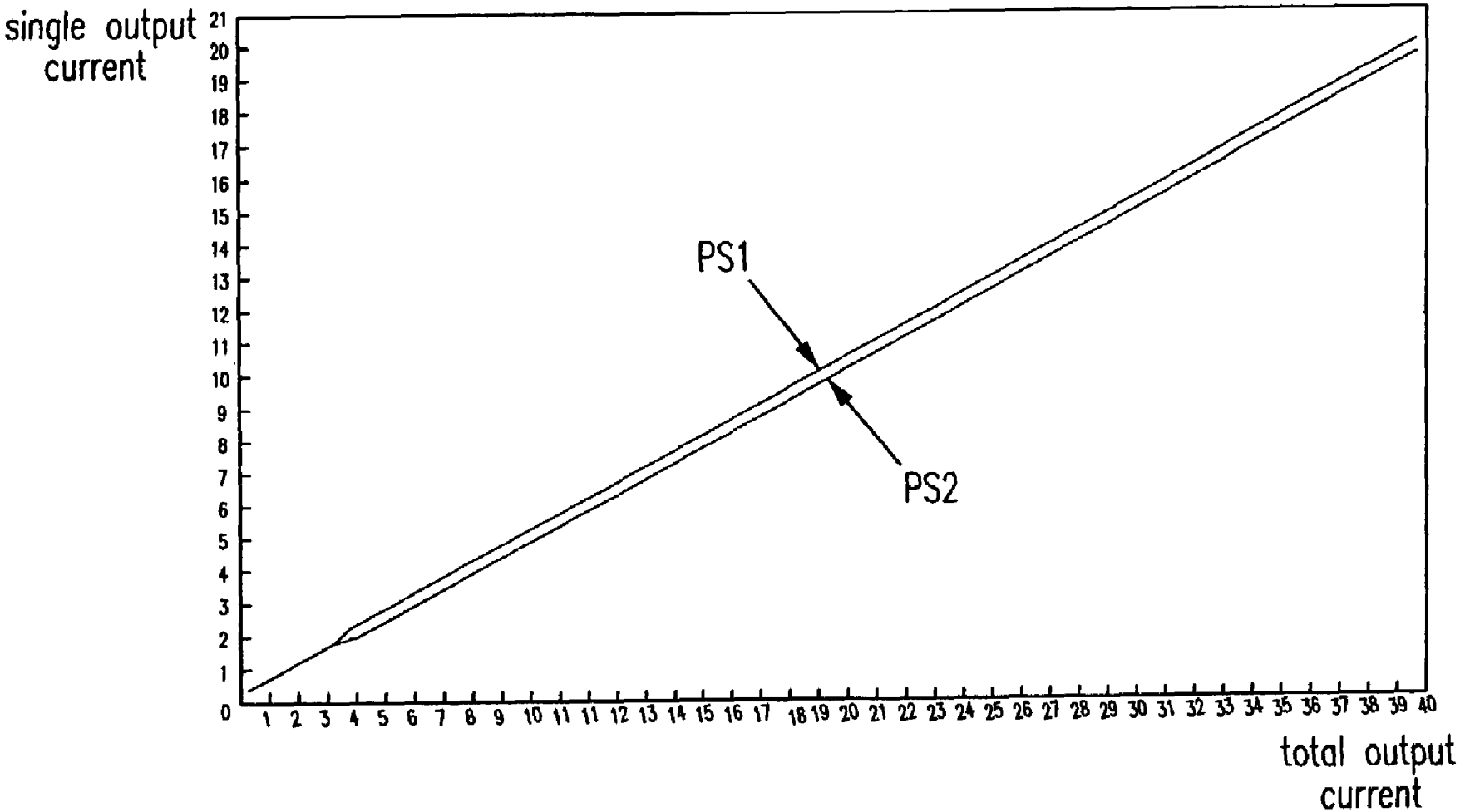
Figure 3D:
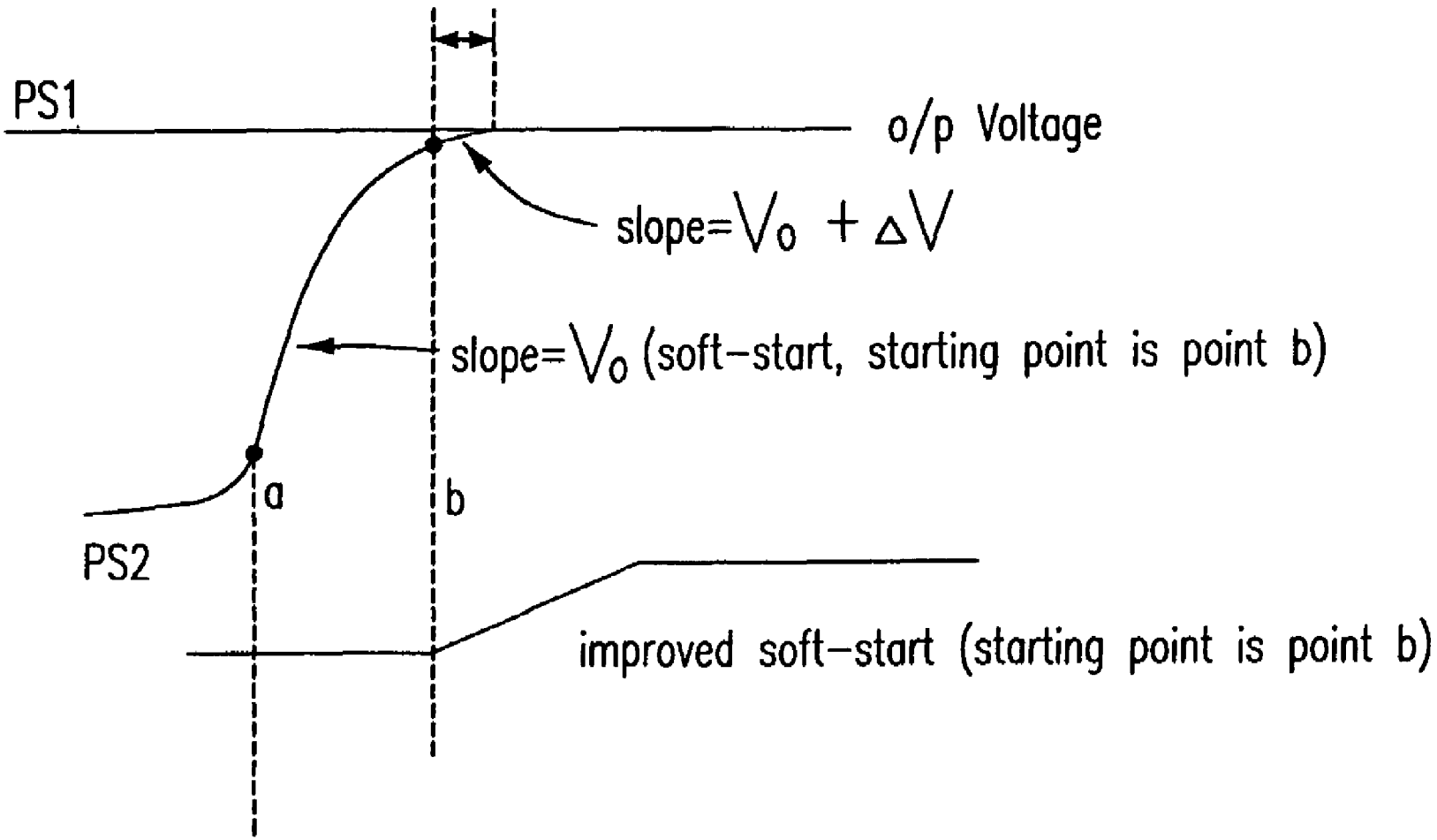
Figure 3E:
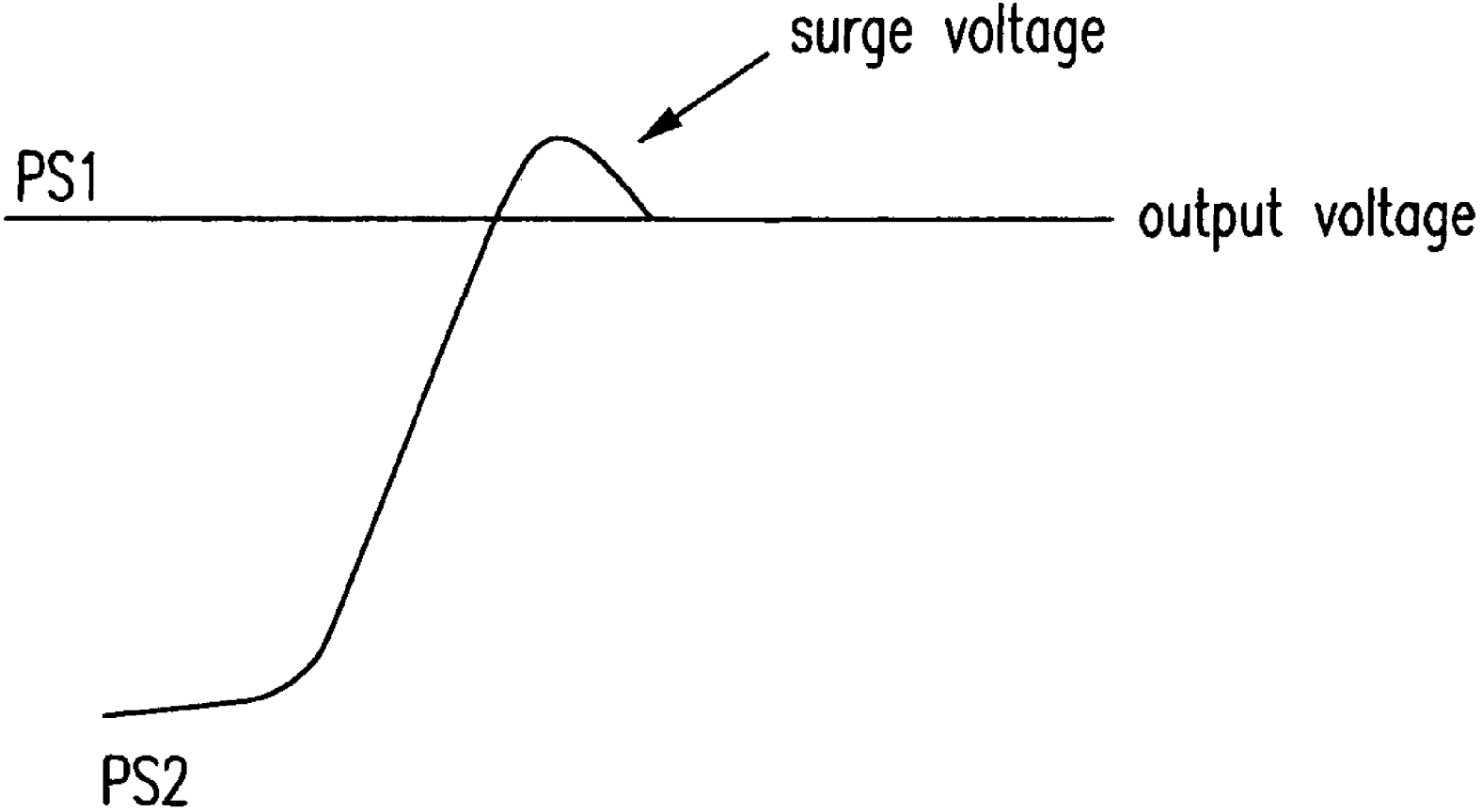
Fig. 3(e)(PRIOR ART)
Figure 3F:
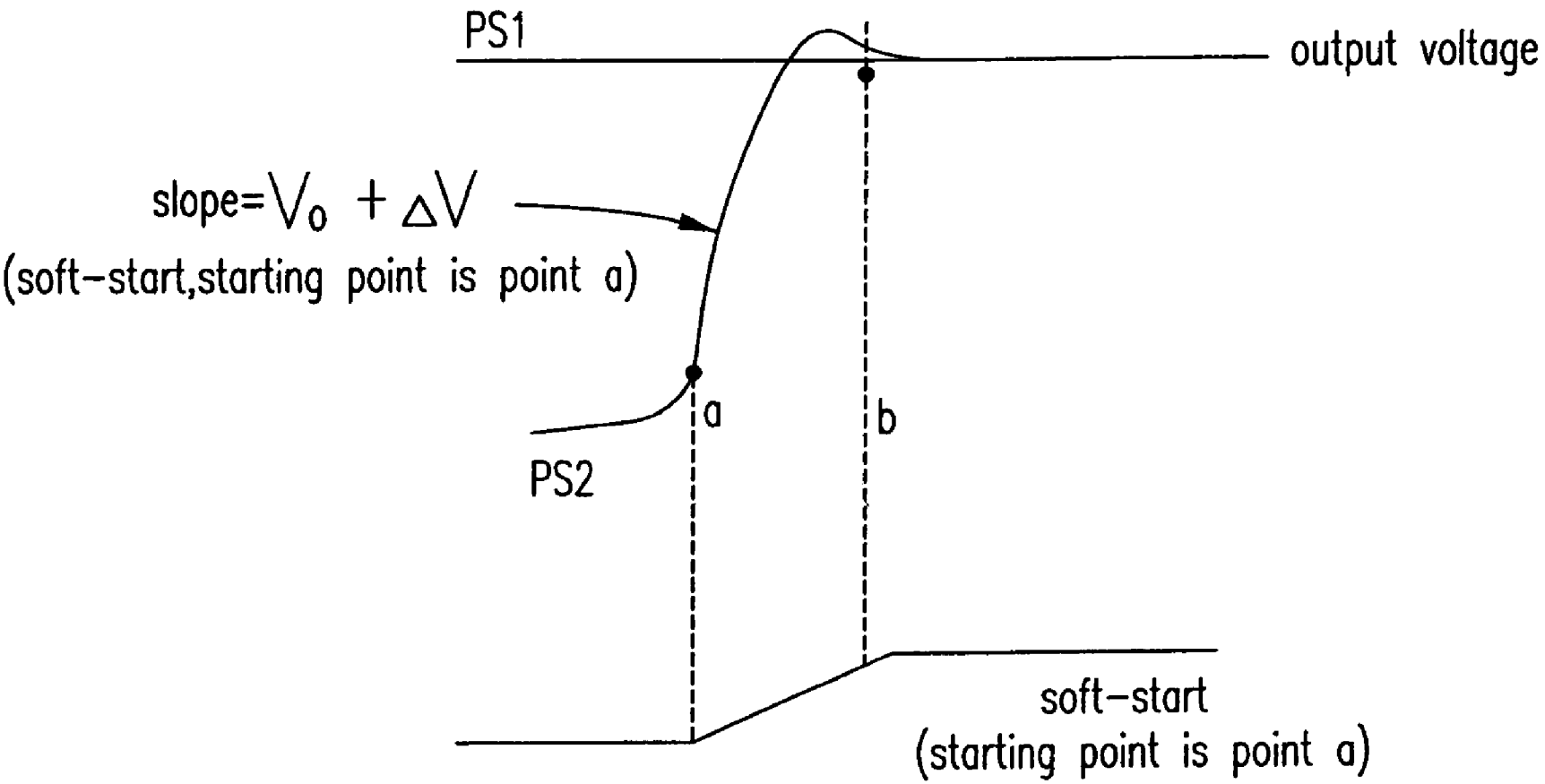
Fig. 3(f) (PRIOR ART)

Please refer to FIG. 2 (*a*), which schematically illustrates the master/slave current distribution circuit according to a first preferred embodiment of the present invention. The master/slave current distribution circuit 2 for a parallel power supply having the first power supply PS1 and the second power supply PS2 includes a negative feedback circuit having a voltage amplifier 21 and an impedance 22, a power converting unit 23, a detecting unit 24, an equivalent diode 25, an adjustable amplifier 26, an adder 27 and an active droop unit 28. The power converting unit 23 has an input electrically connected to an output of the voltage amplifier 21 and an output electrically connected to a load. The detecting unit 24 has an input electrically connected to the output of the power converting unit 23 and the load. The equivalent diode 25 has an input electrically connected to the output of the detecting unit 24 and an output electrically connected to the first power supply PS1 and the second power supply PS2. The adjustable amplifier 26 has an inverting input electrically connected to the input of the equivalent diode 25 and a non-inverting input electrically connected to the output of the equivalent diode 25, the first power supply PS1 and the second power supply PS2. Moreover, the adder 27 is electrically connected to a non-inverting input of the voltage amplifier 21 and the output of the adjustable amplifier 26, and the active droop unit 28 is electrically connected to the output of the detecting unit 24.

Please refer to FIG. 2(*b*), which illustrates the relationship between the voltage and the current while the voltage is modulated by the active droop unit 28. The working principle of the voltage modulation is that while the load has a value less than a pre-determined value, i.e. under a light-load, an operating voltage reference of the master/slave current distribution circuit 2 would be linearly modulated through the active droop unit 28. In this case, the operation voltage reference is 1%~5% of the maximum of the operation voltage. Such a modulation makes the operation voltage slope of the master/slave current distribution circuit 2 equal to a suggested value $S=\Delta V/(I_o*B)$, wherein $\Delta V$ equaling to $(V_0*A)$ is an applied voltage of the master/slave current distribution circuit 2, $I_o$ and $V_o$ are respective the output current and voltage of the master/slave current distribution circuit 2, and A and B are proportional values which are respectively in ranges of 1%~5% and 5%~10%.

Such a modulation is able to achieve a well linear operation and a high accuracy of the master/slave current distribution circuit 2. Hence the master/slave current distribution circuit 2 is able to reduce an error resulted from the first power supply PS1 and the second power supply PS2 which are electrically connected in parallel under a light-load.

Please refer to FIG. 3(*a*), which schematically illustrates the current distribution circuit according to a second preferred embodiment of the present invention. The master/slave current distribution circuit 3 for a parallel power supply having the first power supply PS1 and the second power supply PS2 includes a negative feedback circuit having a voltage amplifier 31 and an impedance 32, a power converting unit 33, a detecting unit 34, an equivalent diode 35, an adjustable amplifier 36, an adder 37 and an active droop unit 38. Moreover, the master/slave current distribution circuit 3 is able to have both or each one of the gap voltage modulator 391 and the soft-start circuit 392. The gap voltage modulator 391 is electrically connected between the output of the detecting unit 34 and the non-inverting input of the adjustable amplifier 36, so as to modulate a gap voltage therebetween.

Please refer to FIG. 3(*b*), which schematically illustrates the modulation by the gap voltage modulator 391. While the load has a first value less than the pre-determined value, the gap voltage modulator 391 is able to increase the gap voltage for reducing an unstability generated from the first power supply PS1 and the second power supply PS2 which are electrically connected in parallel under a light-load. On the contrary, while the load has a second value larger than the pre-determined value, the gap voltage is decreased by the gap voltage modulator 391 for reducing an error generated from the first power supply PS1 and the second power supply PS2 which are electrically connected in parallel under a heavy-load.

Figure 1A:
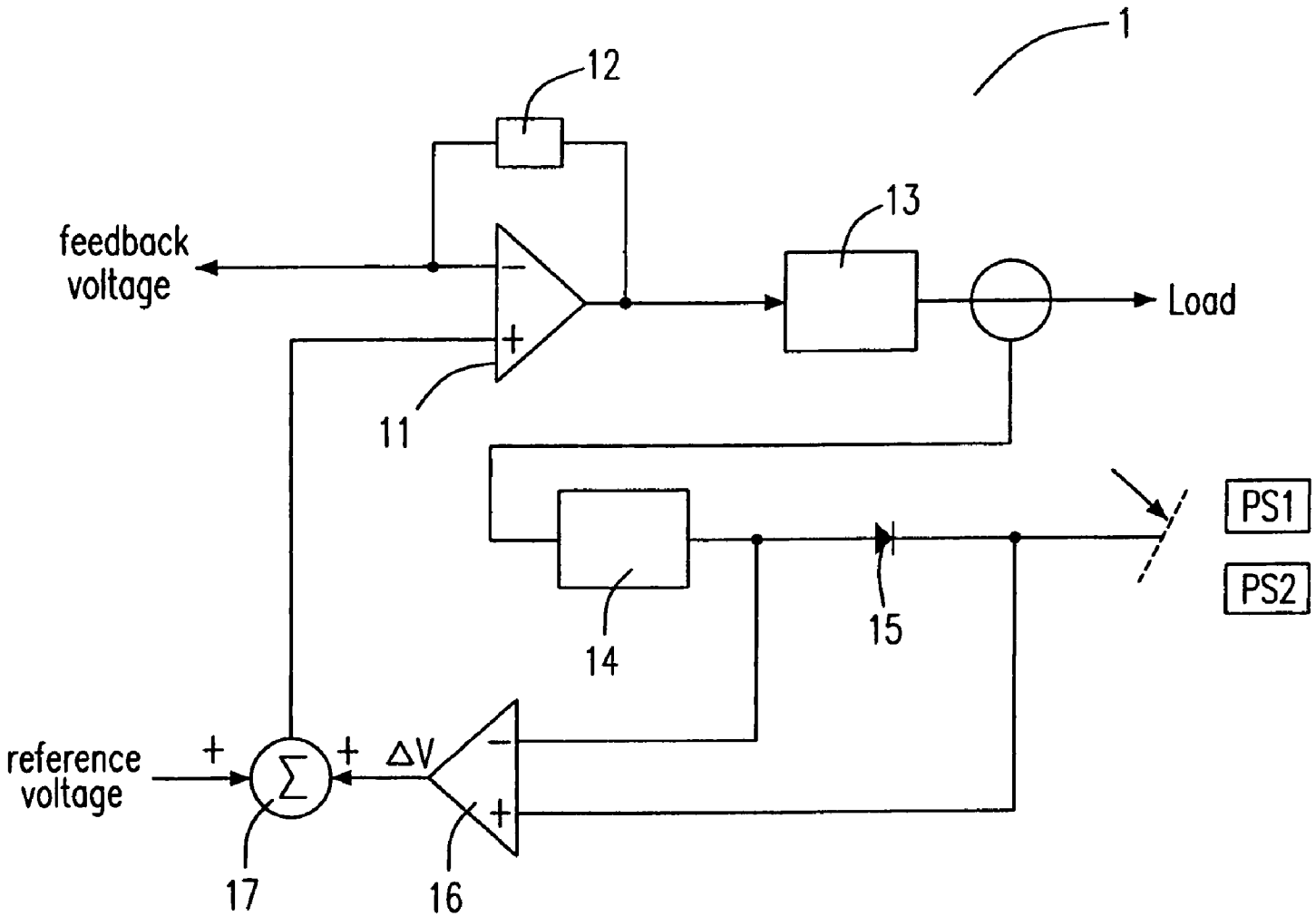
Fig. 1(a)(PRIOR ART)
FIG. 1(*a*) is a diagram illustrating the master/slave current distribution circuit according to the prior art.
Figure 1B:
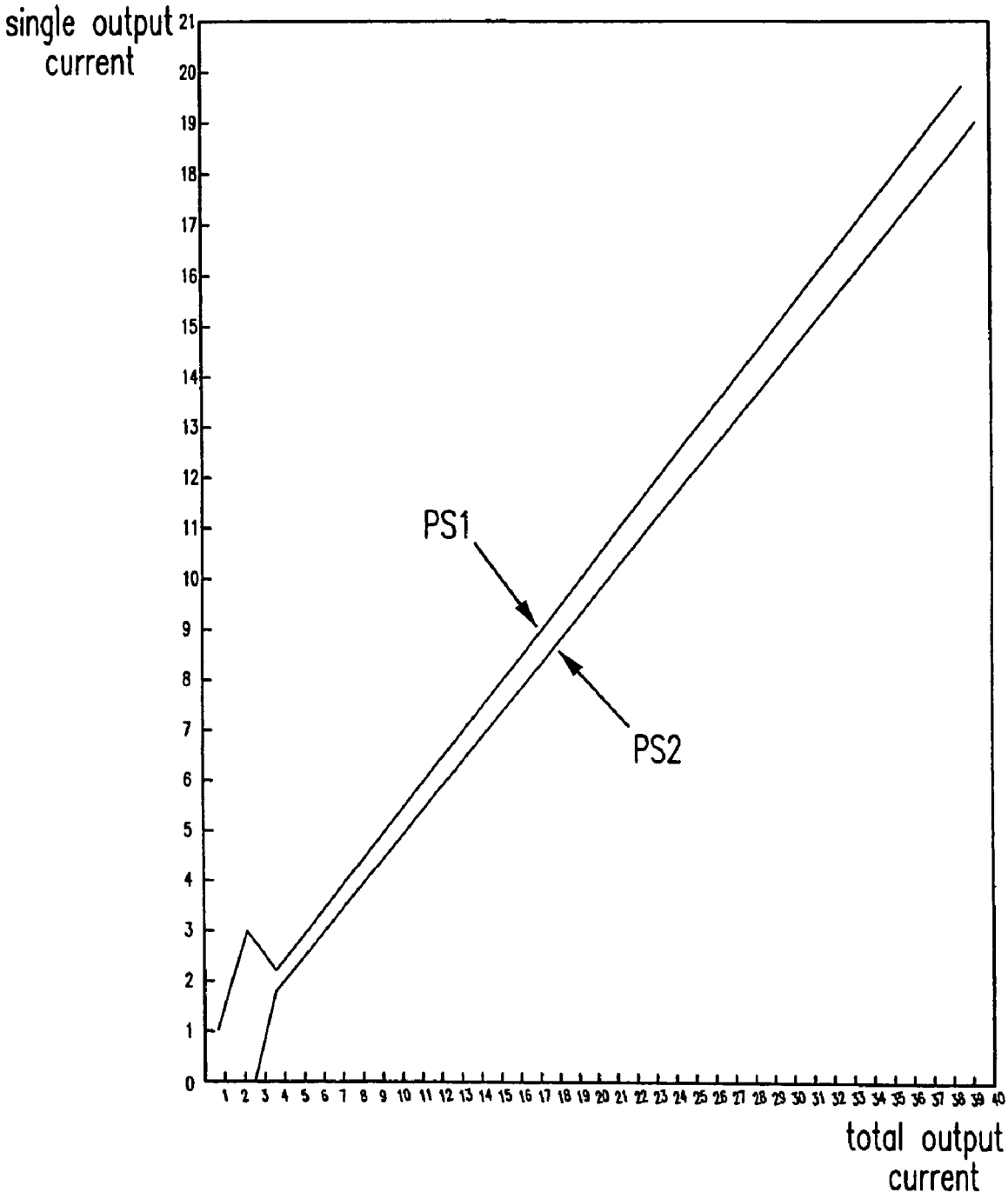
Fig. 1(b)(PRIOR ART)

Please refer to FIG. 3(*c*), which schematically illustrates the relationships between the currents respectively output from the first power supply PS1 and the second power supply PS2. Compared with that in FIG. 1(*b*), no matter the first power supply PS1 and the second power supply PS2 are under a light-load or a heavy-load, the respective signal output currents thereof are extremely stable.

Furthermore, by feeding a voltage of the master/slave current distribution circuit 3, which is output to the load, back to the soft-start circuit 392, the soft-start circuit 392 would have a starting point which is set for the point b, as shown in FIG. 3(*d*), and a voltage equaling to a proportional value, i.e. 90%, of the output voltage. The surge voltage of the second power supply PS2 resulting from the first power supply PS1 hot-plugging into the parallel power supply while in operation, is able to be effectively prevented.

According to FIG. 3(*d*), when the soft-start circuit 392 has a starting point which is set for the point b and a voltage equaling to 90%~95% of the output voltage, the surge voltages of the output voltages respectively of the first power supply PS1 and the second power supply PS2 are effectively inhibited. Therefore, the problem of the overshoot surge voltage of the first power supply PS1 resulting from the second power supply PS2 being hot-plugged into the parallel power supply while in operation, with reference to FIG. 3(*e*), is able to be solved by the soft-start circuit 392. Moreover, the use of the soft-start circuit 392 also solves the problem of the uncomplete performing of the conventional ones and the problem of a few surges still generated therein, those are shown in FIG. 3(*f*).

Figure 4:
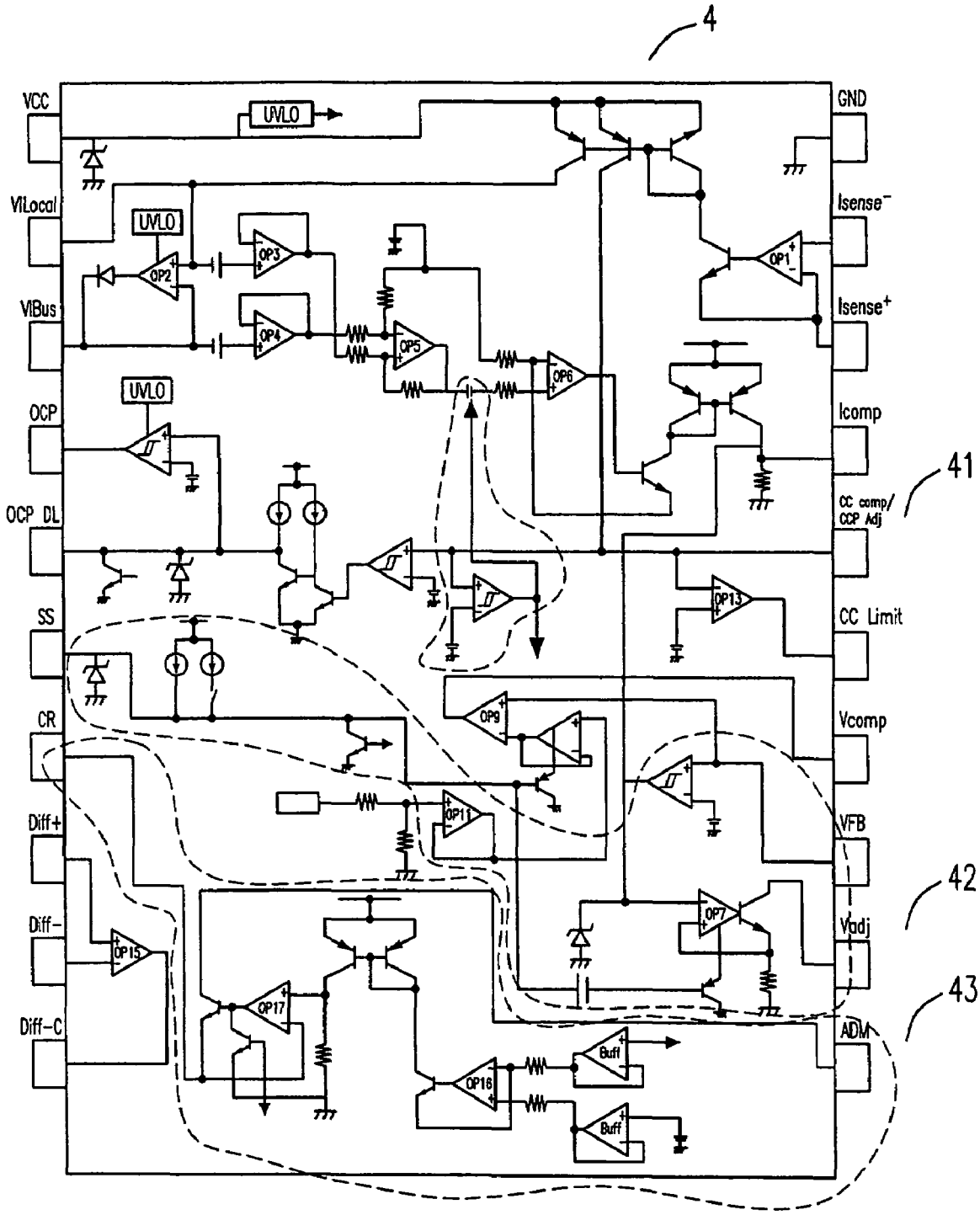
FIG. 4 is a diagram illustrating the master/slave current distribution circuitry according to a third preferred embodiment of the present invention.

Please refer to FIG. 4, which illustrates the master/slave currents distribution circuitry according to another preferred embodiment of the present invention. The active droop unit 43 could be separately or simultaneously arranged with the gap voltage modulator 41 and the soft-start circuit 42 in the master/slave current distribution circuitry 4 to stabilize the parallel power supply including the first power supply and the second power supply.

Hence, the present invention not only has novelty and progressiveness, but also has an industry utility.

While the invention has been described in terms of what is presently considered to be the most practical and preferred embodiment, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A current distribution circuit for parallel power supplies comprising at least a first power supply and a second power supply, said current distribution circuit comprising:

a voltage amplifier;

a power converting unit having an input electrically connected to an output of said voltage amplifier and an output electrically connected to a load;

a detecting unit having an input electrically connected to said output of said power converting unit and said load;

an equivalent diode having an input electrically connected to an output of said detecting unit and an output electrically connected to said parallel power supplies;

an adjustable amplifier having an inverting input electrically connected to said output of said detecting unit and said input of said equivalent diode and a non-inverting input electrically connected to said output of said equivalent diode and said parallel power supplies;

an adder electrically connected to a non-inverting input of said voltage amplifier and an output of said adjustable amplifier; and an active droop unit electrically connected to said output of said detecting unit.

2. The current distribution circuit according to claim 1, wherein an operating voltage reference of said active droop unit is linearly adjusted for reducing an error resulting from said first power supply and said second power supply while said load is less than a pre-determined value.

3. The current distribution circuit according to claim 1, being a master/slave circuit.

4. The current distribution circuit according to claim 1, wherein a reference value of an operating voltage is 1%~5% of a value of an output voltage of said current distribution circuit.

5. The current distribution circuit according to claim 1, wherein said voltage amplifier further comprises a negative feedback circuit.

6. The current distribution circuit according to claim 5, wherein said negative feedback circuit comprises an impedance.

7. The current distribution circuit according to claim 1, further comprising a gap voltage modulator electrically connected between said output of said detecting unit and said non-inverting input of said adjustable amplifier for modulating a gap voltage therebetween.

8. The current distribution circuit according to claim 7, wherein said gap voltage is raised by said gap voltage modulator while a first Value of said load is less than a pre-determined value and is lowered while a second value of said load is more than said pre-determined value, so as to eliminate an unstability of said first power supply and said second power supply under a light-load.

9. The current distribution circuit according to claim 8, wherein said voltage amplifier and said adjustable amplifier are further electrically connected to a soft-start circuit.

10. The current distribution circuit according to claim 9, wherein an output voltage from said current distribution circuit to said load is fed back to said soft-start circuit, so that said soft-start circuit is driven and has a voltage, and when a value of said voltage is equal to a proportional value of said output voltage, a surge voltage of said output voltage is lowered while said second power supply is operated behind said first power supply.

11. The current distribution circuit according to claim 10, wherein said proportional value is 90%~95% of said output voltage.

12. A current distribution circuit for parallel power supplies comprising at least a first power supply and a second power supply, said current distribution circuit comprising:

a voltage amplifier;

a power converting unit having an input electrically connected to an output of said voltage amplifier and an output electrically connected to a load;

a detecting unit having an input electrically connected to said output of said power converting unit and said load; and an active droop unit electrically connected to said output of said detecting unit.

13. The current distribution circuit according to claim 12, wherein an operating voltage reference of said active droop unit is linearly adjusted for reducing an error resulting from said first power supply and said second power supply while said load is less than a pre-determined value.

14. The current distribution circuit according to claim 12, being a master/slave circuit.

15. The current distribution circuit according to claim 12, further comprising an equivalent diode having an input electrically connected to an output of said detecting unit and an output electrically connected to said parallel power supplies.

16. The current distribution circuit according to claim 15, further comprising an adjustable amplifier having an inverting input electrically connected to said output of said detecting unit and said input of said equivalent diode and a non-inverting input electrically connected to said output of said equivalent diode and said parallel power supplies.

17. The current distribution circuit according to claim 16, further comprising a gap voltage modulator electrically connected between said output of said detecting unit and said non-inverting input of said adjustable amplifier for modulating a gap voltage therebetween.

18. The current distribution circuit according to claim 17, wherein said gap voltage is raised by said gap voltage modulator while a first value of said load is less than a pre-determined value and is lowered while a second value of said load is more than said pre-determined value, so as to eliminate an unstability of said first power supply and said second power supply under a light-load.

19. The current distribution circuit according to claim 18, wherein said voltage amplifier and said adjustable amplifier are further electrically connected to a soft-start circuit.

20. The current distribution circuit according to claim 19, wherein an output voltage from said current distribution circuit to said load is fed back to said soft-start circuit, so that said soft-start circuit is driven and has a voltage, and when a value of said voltage is equal to a proportional value of said output voltage, a surge voltage of said output voltage is lowered while said second power supply is operated behind said first power supply.

* * * * *